US005228420A

United States Patent [19]

Furuya et al.

[11] Patent Number: 5,228,420

[45] Date of Patent: Jul. 20, 1993

[54] VALVE ROCKER COVER

[75] Inventors: Katsuji Furuya, Tokyo; Shigeki Ogawa; Kyoko Kishimoto, both of Saitama, all of Japan

[73] Assignee: Tsuchiya Mfg. Co., Ltd., Tokyo, Japan

[21] Appl. No.: 950,266

[22] Filed: Sep. 25, 1992

[51] Int. Cl.[5] ..... F01M 9/10; F02F 7/00

[52] U.S. Cl. ..... 123/90.38; 123/195 C

[58] Field of Search ..... 123/90.33, 90.37, 90.38, 123/196 M, 195 C, 198 E

[56] References Cited

U.S. PATENT DOCUMENTS

| | | | |
|---|---|---|---|
| 4,538,560 | 9/1985 | Alden | 123/90.38 |
| 4,593,659 | 6/1986 | Wells et al. | 123/90.38 |
| 4,608,950 | 9/1986 | Payne et al. | 123/90.38 |
| 4,898,125 | 2/1990 | Ampferer | 123/195 C |
| 4,993,375 | 2/1991 | Akihiko | 123/90.38 |
| 5,003,958 | 4/1991 | Yoneyama et al. | 123/90.38 |
| 5,058,542 | 10/1991 | Grayson et al. | 123/90.38 |
| 5,095,860 | 3/1992 | Newell | 123/90.38 |
| 5,129,371 | 7/1992 | Rosalik, Jr. | 123/90.38 |

FOREIGN PATENT DOCUMENTS

| | | | |
|---|---|---|---|
| 268200 | 5/1988 | European Pat. Off. | 123/195 C |
| 3634735 | 4/1988 | Fed. Rep. of Germany | 123/195 C |
| 59-157516 | 10/1984 | Japan . | |
| 131955 | 6/1987 | Japan | 123/195 C |
| 189355 | 8/1987 | Japan | 123/195 C |
| 63-105712 | 8/1988 | Japan . | |

*Primary Examiner*—E. Rollins Cross
*Assistant Examiner*—Weilun Lo
*Attorney, Agent, or Firm*—Foley & Lardner

[57] ABSTRACT

A valve rocker cover is securely mounted on a cylinder head of an internal combustion engine. The valve rocker cover includes a rocker cover main body made of a plastic and of a generally upturned vessel shape so as to be opened at its bottom end. The main body includes a roof section which is formed with a plurality of openings through which metal pipe members extending from the cylinder head are respectively disposed. A plurality of annular oil seal members are disposed coaxial respectively with the openings and made of an elastomeric material. The annular inward lip section of each seal member is in contact with the metal pipe member. A plurality of annular support members for the oil seal members are disposed coaxial respectively with the openings and made of a plastic. The annular outward section of the oil seal member is fixedly secured to the inner peripheral portion of each annular support member. The rocker cover main body is formed with a surface facing downward, forming part of the rocker cover main body. Each annular support member is welded at its top surface to the downward facing surface of the rocker cover main body.

6 Claims, 4 Drawing Sheets

VALVE ROCKER COVER

BACKGROUND OF THE INVENTION

1. Field of the Invention

This invention relates to improvements in a valve rocker cover, and more particularly to a valve rocker cover made of a plastic and of the type of being formed at its roof section with a plurality of openings through which spark plugs are installed to a cylinder head on which the valve rocker cover is mounted.

2. Description of Prior Art

Internal combustion engines of the type wherein spark plugs are vertically installed onto a cylinder head have been well known as disclosed, for example, in Japanese Utility Model Publication No. 59-157516. Such engines require a valve rocker cover formed with openings through which the spark plugs are inserted to be installed to the cylinder head. The valve rocker cover has been usually formed of a metal. Each opening is defined inside a cylindrical wall section integral with the main body of the valve rocker cover. The cylindrical wall section is sealingly connected to a metal pipe extending from the cylinder head so that the opening is in communication with the inside of the metal pipe, isolating the inside of the valve rocker cover from the opening. Accordingly, blow-by gases in the valve rocker cover are prevented from leaking out through the opening.

Recently, such a valve rocker cover has been formed of plastic or synthetic resin for the purpose of weight-lightening and cost reduction. With the plastic-made valve rocker cover, the rocker cover side cylindrical wall section is disposed coaxial with and around the cylinder head side metal pipe, in which an annular oil seal is disposed between them to maintain a gas tight seal thereby interrupting communication between the inside of the valve rocker cover and atmospheric air. Such an oil seal member is subjected to vibration of the valve rocker cover itself and vibration transmitted through the metal pipe from the cylinder head, and therefore the oil seal member is required to be securely and rigidly supported to the rocker cover side cylindrical wall section to prevent blow-by gases from leaking out of the valve rocker cover and to prevent the oil seal member from getting out of place. Additionally, the valve rocker cover is made of plastic and fabricated by a molding, so that the cylindrical wall section has a draft and unavoidably has deformation and an imperfect right circular formation in cross-section upon the molding. It will be understood that it is difficult to fabricate the oil seal member in the shape corresponding to the draft, deformation and the like. Accordingly, no tight contact part is formed between the cylindrical wall section and the oil seal member, and nonuniform internal stress is developed upon elastic deformation in use. As a result, insufficient tight contact and securing of the oil seal member relative to the cylindrical wall section will occur, thereby causing danger of blow-by gases leaking and the oil seal member getting out of place.

SUMMARY OF THE INVENTION

It is an object of the present invention to provide an improved valve rocker cover which is made of a plastic and of the type having a plurality of openings through which pipe members extending from a cylinder head are respectively disposed, the valve rocker cover being able to maintain a sufficient gas tight seal relative to the pipe members even upon vibration of the valve rocker cover itself and the cylinder head.

Another object of the present invention is to provide an improved valve rocker cover which is made of a plastic and of the type having a plurality of openings through which pipe members extending from a cylinder head are respectively disposed, the valve rocker cover being provided with oil seal members to maintain gas and oil tight seal between the main body of the valve rocker cover and the pipe members, the oil seal members being fixedly secured to a valve rocker cover side without deformation so as to keep a gas and oil tight contact relative to the pipe members on the cylinder head side.

A valve rocker cover of the present invention is mounted on a cylinder head of an internal combustion engine. The valve rocker cover comprises a rocker cover main body made of a plastic and of a generally upturned vessel shape so as to be opened at its bottom end. The rocker cover main body includes a roof section formed at a top end thereof. The roof section is formed with a plurality of openings through which pipe members extending from the cylinder head are respectively disposed. A plurality of annular oil seal members are provided coaxial respectively with the openings and are made of an elastomeric material. Each oil seal member includes an annular inward section to be in contact with the pipe member, and an annular outward section. A plurality of annular support members for the oil seal members are provided to be coaxial respectively with the openings and made of a plastic. Each support member has an inner peripheral portion to which the oil seal member outward section is fixedly secured. The rocker cover main body is formed with a surface which faces downward and forms part of the rocker cover main body. Each annular support member is welded at its top surface with the downwardly facing surface of the rocker cover main body.

Accordingly, the oil seal member is fixedly secured to the support member. The support member is small in size as compared with the rocker cover main body, annular, and precisely fabricated by a molding, thus causing no problem in securing to the rocker cover main body. The top surface of the oil seal member and the downward facing surface of the rocker cover main body can be formed flat to lessen deformation. Additionally, the support member is welded to the flat downward facing surface of the rocker cover main body, in which sufficient welding bonding is made between the support member and the rocker cover main body even if there is a slight deformation at the welded flat surfaces of the support member and the rocker cover main body, thus providing a sufficient gas and oil tight seal between the rocker cover main body and the pipe members on the cylinder head side, while preventing the oil seal member from getting out of place.

BRIEF DESCRIPTION OF THE DRAWINGS

In the drawings, like reference numerals designate like parts and elements throughout all figures, in which.

DETAILED DESCRIPTION OF THE INVENTION

Figure 1:
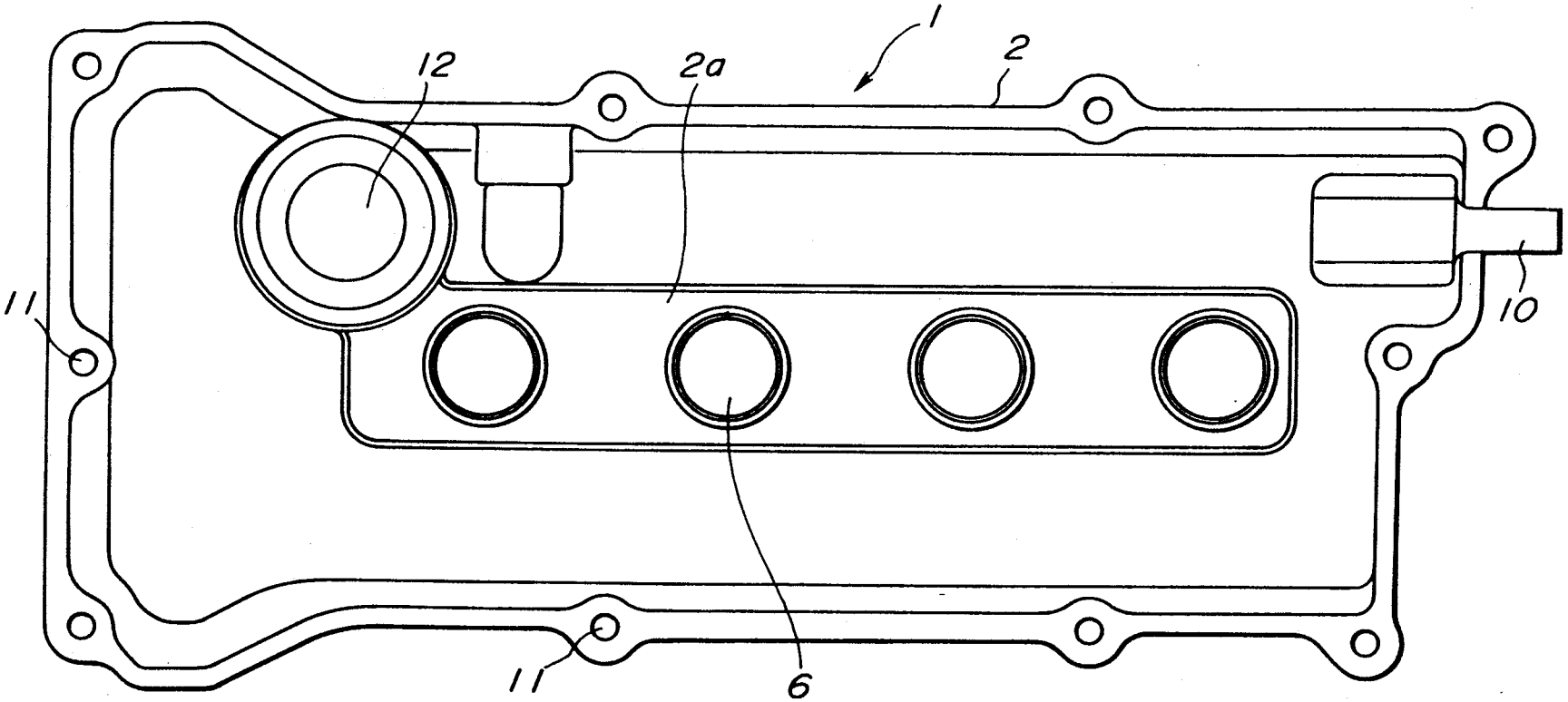
FIG. 1 is a plan view of an embodiment of a valve rocker cover according to the present invention.
Figure 2:
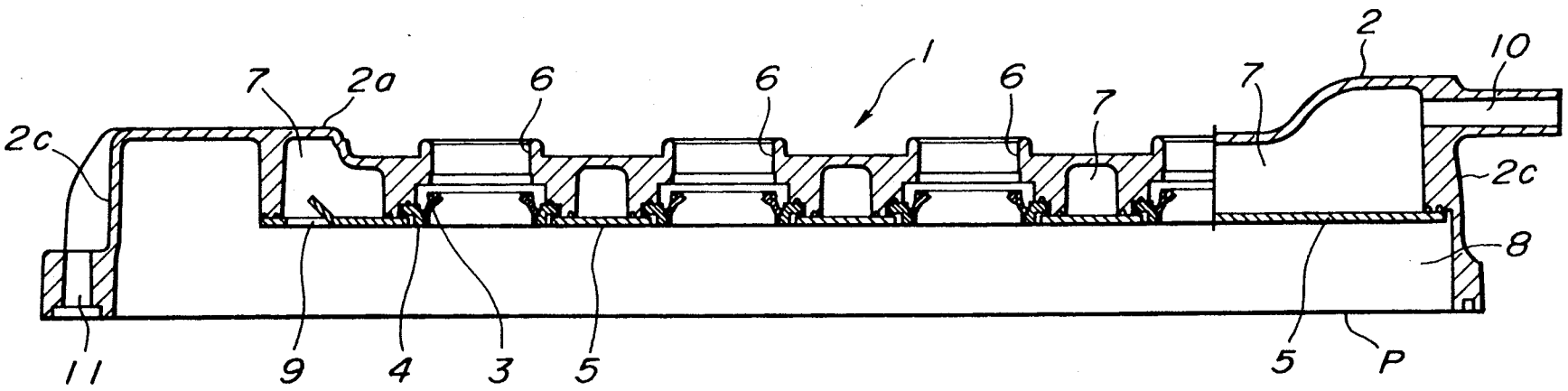
FIG. 2 is a longitudinal and vertical sectional view of the valve rocker cover of FIG. 1.
Figure 3:
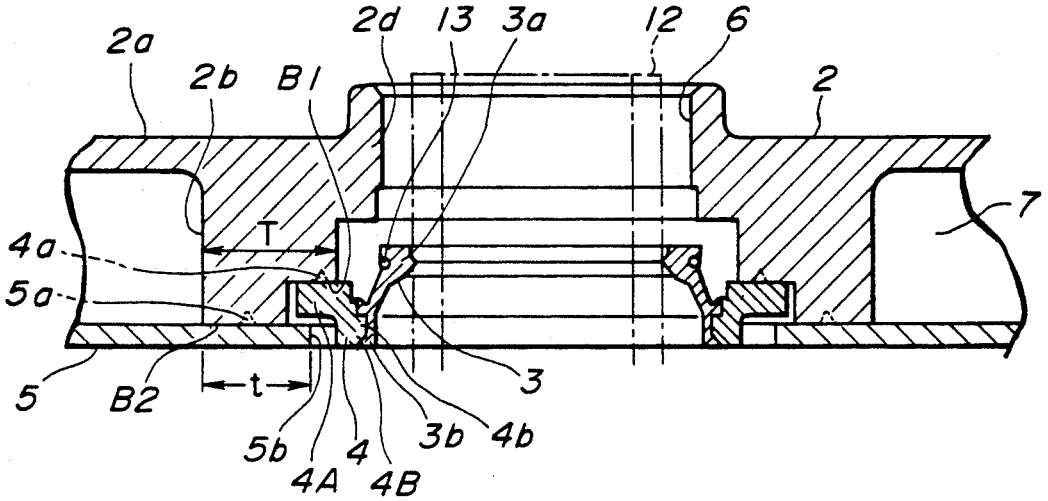
FIG. 3 is a fragmentary sectional view of an essential part of the valve rocker cover of FIG. 1.

Referring now to FIGS. 1 to 3 of the drawings, an embodiment of a valve rocker cover or cylinder head cover according to the present invention is illustrated by the reference numeral 1. The valve rocker cover 1 is securely mounted on a cylinder head of an internal combustion engine (not shown) with bolts (not shown) to be disposed in bolt holes 11 of the valve rocker cover 1. The valve rocker cover 1 defines thereinside a valve rocker chamber 8 in which a valve operating mechanism including a camshaft and/or valve rocker arms is to be disposed, though not shown. The valve rocker cover 1 of this embodiment comprises a rocker cover main body 2 made of a plastic or synthetic resin and formed into a generally upturned-vessel or -container box shape so that its bottom end is opened.

The rocker cover main body 2 includes a roof section **2*a* at its upper end which roof section 2*a* is formed with a plurality of openings 6. An oil pouring opening 12 is also formed in the roof section 2*a*. The rocker cover main body 2 further includes a plurality of cylindrical sections 2*b* which are located corresponding respectively to the openings 6. Each cylindrical section 2*b* is integral with the roof section 2*a* and extends downwardly from the roof section 2*a* in such a manner that each opening 6 is coaxial with the corresponding cylindrical section 2*b*. A side wall section 2*c* is integral with the roof section 2*a*** and extends generally downwardly to form the bottom end which defines a bottom opening P and to be in contact with the cylinder head.

As shown, the bottom end of each cylindrical section **2*b* is higher in level than and separate from the bottom end of the side wall section 2*c*. A baffle plate 5 made of a plastic or synthetic resin is fixedly disposed inside the valve rocker cover 1 to define a blow-by gas treating chamber 7 at the inside upper part of the valve rocker chamber 8. The blow-by gas treating chamber 7 is formed around each opening 6 and around each cylindrical section 2*b*. Accordingly, blow-by gases supplied into the valve rocker chamber 8 are introduced into the blow-by gas treating chamber 7 through a blow-by gas inlet opening 9 and discharged out of the blow-by gas treating chamber 7 through a blow-by gas outlet opening 10. An oil mist separating filter (not shown) is disposed in the blow-by gas treating chamber 7 to separate oil mist from blow-by gases. The blow-by gases discharged out of the blow-by gas treating chamber 7 are recirculated back to combustion chambers (not shown) of the engine. As shown, the baffle plate 5 is fixed to the bottom end of each cylindrical section 2*b* and to the stepped portions (not identified) of the side wall section 2*c* by vibration welding, thus defining the blow-by gas treating chamber 7 in cooperation with the rocker cover main body 2. The vibration welding welds the required parts of the baffle plate 5 and the cylindrical section 2*b*** by employing frictional heat under vibration.

A generally cylindrical guide section **2*d* is formed integral with the cylindrical section 2*b* and extends radially inwardly from the inner wall surface of the cylindrical section 2*b*. The guide section 2*d* is arranged coaxial with the cylindrical section 2*b* and functions to guide and be located around a steel pipe member 12 which extends from the cylinder head. Through the pipe member 12**, a spark plug (not shown) is inserted to be installed to the cylinder head.

An oil seal member 3 is disposed inside the rocker cover main body 2 and securely connected to the bottom end of each cylindrical section **2*b*. The oil seal member 3 is made of an elastomeric material such as a synthetic rubber. The oil seal member 3 includes an annular inward lip section 3*a* which is to be in sealing contact with the pipe member 12. An annular coiled spring 13 is fitted on the outer peripheral surface of the inward lip section 3*a*. The oil seal member 3 includes an annular outward section 3*b* which is fixedly secured to an annular support member 4 at the inner peripheral portion 4*b*. The support member 4 is made of a plastic or synthetic resin and includes an annular main section 4A having a generally rectangular cross-section. An annular flange section 4B is integral with the main section and extends downwardly from the main section 4A. The inner peripheral portion 4*b* of the support member 4 and the outer peripheral portion (not identified) of the outward section 3*b* of the oil seal member 3 have a corresponding unevenness at their surfaces so that they are in tight contact with each other. In this embodiment, the unevenness of the support member 4 is formed mainly at the inner peripheral surface of the flange section 4B. The oil seal member 3 is bonded to the support member 4 under vulcanization adhesion in which adhesion is caused by vulcanization of the elastomeric material of the oil seal member 3**.

In this embodiment, the bottom end of each cylindrical section **2*b* of the valve rocker cover main body 2 is formed step-like to have an upper flat surface B1 and a lower flat surface B2. The upper flat surface B1 is located radially inward relative to the lower flat surface B2. The support member 4 is welded to the bottom end of the cylindrical section 2*b* under ultrasonic welding, in such a manner that the top surface of the support member 4 is in tight and integral contact with the upper flat surface B1 of the cylindrical section 2*b*. The baffle plate 5 is welded to the bottom end of the cylindrical section 2*b* by vibration welding, in such a manner that the top surface of the baffle plate 5 is in tight and integral contact with the lower flat surface B2 of the cylindrical section 2*b***.

As shown, the baffle plate 5 is formed at its top surface with a rib **5*a* which is molten during the vibration welding and disappears after completion of the welding. It will be understood that the baffle plate 5 is formed with a plurality of through-openings 5*b* corresponding respectively to the openings 6. In order to form the rib 5*a*, a distance t is required from the periphery of each through-opening 5*b*. In this embodiment, a portion of the baffle plate 5 corresponding to a part of the distance t projects inwardly over the lower flat surface B2 and extends below the support member 4, so that the support member 4 and the baffle plate 5 are partly overlapped. Such overlapping contributes to reduction of the thickness T of each cylindrical section 2*b* of the rocker cover main body 2. More specifically, the projecting portion of the baffle plate 5 is generally annular and positioned in an annular space defined by the main section 4A and the flange section 4B of support member 4**.

The support member 4 is formed at its top surface with a plurality of small projections 4*a* extending upwardly. The support member 4 is welded at its top surface to the upper flat surface B1 of the bottom end of each cylindrical section 2*b* by ultrasonic welding. The support member 4 is arranged coaxial with the cylindrical section 2*b*. The small projections 4*a* are molten during the welding and disappears after completion of the welding, so that the top surface of the support member 4 is brought into integral and tight contact with the bottom end upper flat surface B1 of the cylindrical section 2*b*.

As appreciated from the above, the bottom end surfaces B1, B2 of the cylindrical section 2*b* and the top surface of the support member 4 can be formed flat without deformation. Additionally, the support member 4 is annular and therefore can be precisely fabricated. Even if a slight deformation is made at the bottom end surfaces B1, B2 of the cylindrical section 2*b* and the top surface of the support member 4, such a deformation can be compensated by the molten plastic of the projections 4*a*, thereby ensuring a tight contact and a sufficient joining strength between the cylindrical section 2*b* and the support member 4.

Figure 4:
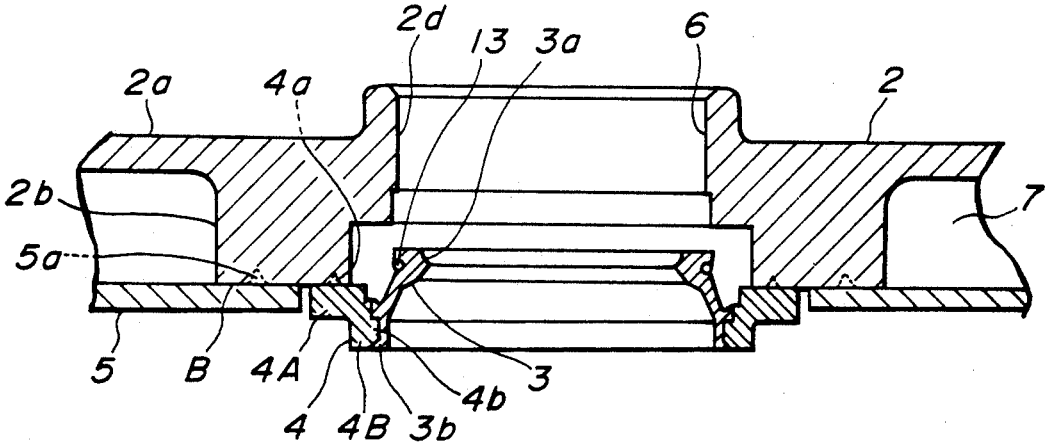
FIG. 4 is a fragmentary sectional view similar to FIG. 3 but showing another embodiment of the valve rocker cover in accordance with the present invention.

FIG. 4 illustrates an essential part of another embodiment of the valve rocker cover 1 according to the present invention, which is similar to the above embodiment with the exception that the bottom end surface of each cylindrical section 2*b* of the rocker cover main body 2 is formed flat to provide a flat bottom end surface B. Accordingly, the top surfaces of the oil seal member 4 and the baffle plate 5 are in flush with each other and bonded to the bottom end surface B of each cylindrical section 2*b*.

Figure 5:
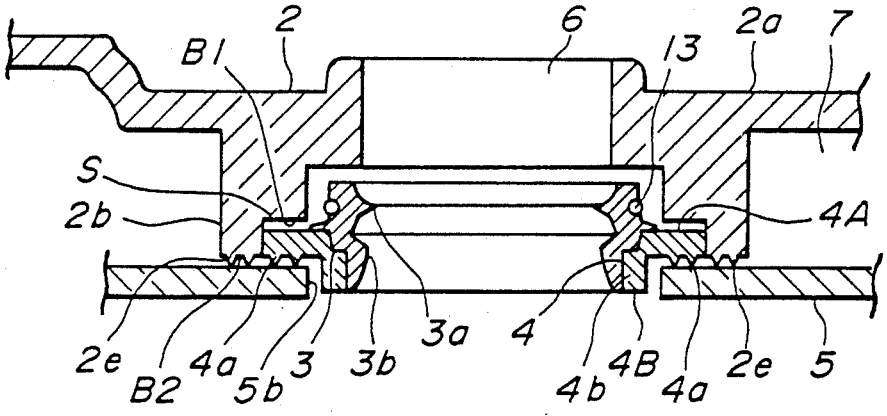
FIG. 5 is a fragmentary sectional view similar to FIG. 3 but showing a further embodiment of the valve rocker cover in accordance with the present invention.

FIG. 5 illustrates an essential part of a further embodiment of the valve rocker cover according to the present invention, which is similar to the embodiment of FIG. 3. In this embodiment, the small projections 4*a* are formed on the bottom surface of the main section 4A of the support member 4. The support member main section 4A is bonded to the baffle plate 5 by vibration welding in such a manner that the bottom surface of the main section 4A is in tight and integral contact with the top surface of the baffle plate 5. The small projections 4*a* are molten during the welding and disappear after completion of the welding.

A plurality of small projections 2*e* are formed on the lower flat surface B2 of the cylindrical section 2*b* and protrude downwardly. The baffle plate 5 securely incorporated with the support member 4 is bonded to the cylindrical section 2*b* by vibration welding in such a manner that the top surface of the baffle plate 5 is in tight and integral contact with the lower flat surface B2 of the cylindrical section 2*b*. The small projections 2*e* are molten during the welding and disappear after the completion of the welding thereby ensuring the bonding between the baffle plate 5 and the rocker cover main body cylindrical section 2*b*. As shown, when the baffle plate 5 is bonded to the cylindrical section 2*b*, the main section 4A of the support member 4 is positioned in an annular space S formed below the upper flat surface B1 of the bottom end of the cylindrical section 2*b*. The vertical distance of the space S is slightly larger than the vertical thickness of the main section 4A of the support member 4. Such a dimensional relationship between the support member 4 and the cylindrical section 2*b* can be maintained even when the baffle plate 5 is in direct contact with the lower flat surface B2 of the cylindrical section 2*a* to make the bonding of the baffle plate 5 to the cylindrical section 2*b* while the small projections 2*e* are molten and disappear. It will be understood that FIG. 5 shows a state immediately before the welding or bonding of the support member 4 to the baffle plate 5 and of the baffle plate 5 to the rocker cover main body cylindrical section 2*b*.

In connection with this embodiment, the vertical distance of the space S may be generally equal to the vertical thickness of the main section 4A of the support member 4. With this arrangement, the support member 4 is fitted in the space S without previous bonding of the support member 4 to the baffle plate 5. Then, the bottom surface of the support member main section 4A and the lower flat surface B2 of the cylindrical section 2*b* are simultaneously bonded to the baffle plate 5 by welding. This requires only one step welding for bonding the rocker cover main body 2, the support member 4 and the baffle plate 5, thereby simplifying the production process of the valve rocker cover 1.

What is claimed is:

1. A valve rocker cover mounted on a cylinder head of an internal combustion engine, said valve rocker cover comprising:

a rocker cover main body made of a plastic and of a generally upturned vessel shape so as to be opened at its bottom end, said main body including a roof section formed at a top end thereof, said roof section being formed with a plurality of openings through which pipe members extending from the cylinder head are respectively disposed;

a plurality of annular oil seal members which are coaxial respectively with said openings and made of an elastomeric material, each oil seal member including an annular inward section to be in contact with the pipe member, and an annular outward section;

a plurality of annular support members for said oil seal members, said support members being coaxial respectively with said openings and made of a plastic, each support member having an inner peripheral portion to which said oil seal member outward section is fixedly secured; and means defining a surface facing downward, forming part of said rocker cover main body, each annular support member being welded at its top surface to said downward facing surface.

2. A valve rocker cover as claimed in claim 1, further comprising a baffle plate for blow-by gases introduced to the inside of said rocker cover main body, said baffle plate being disposed inside said rocker cover main body and fixedly secured to said downward facing surface of said rocker cover main body to define a chamber through which blow-by gases pass to be treated.

3. A valve rocker cover as claimed in claim 2, wherein said surface defining means includes means defining first and second annular flat surfaces, said first flat annular surface being higher in level than said second flat annular surface so as to define an annular space below said first flat annular surface, at least a major part of said support member being fixedly disposed in said space, said baffle plate being welded to said second flat annular surface.

4. A valve rocker cover as claimed in claim 3, wherein at least a part of said baffle plate extends inwardly over said second flat annular surface and is located below said support member.

5. A valve rocker cover as claimed in claim 3, wherein said baffle plate is welded to said second flat annular surface and to said support member.

6. A valve rocker cover as claimed in claim 1, wherein said rocker cover main body includes a plurality of cylindrical sections which are integral with and extend downwardly from said roof section, said downward facing surface being formed at a bottom end of each cylindrical section.

* * * * *